US005170771A

United States Patent [19]

Peck

[11] Patent Number: 5,170,771

[45] Date of Patent: Dec. 15, 1992

[54] BOW STRING RELEASE WITH STIFF TRIGGER ELEMENT

[75] Inventor: Paul L. Peck, Fond du Lac, Wis.

[73] Assignee: Tru-Fire Corporation, North Fond du Lac, Wis.

[21] Appl. No.: 758,777

[22] Filed: Sep. 12, 1991

[51] Int. Cl.[5] ..... F41B 5/00

[52] U.S. Cl. ..... 124/35.2

[58] Field of Search ..... 124/31, 35.1, 35.2

[56] References Cited

U.S. PATENT DOCUMENTS

| | | | |
|---|---|---|---|
| 3,898,974 | 8/1974 | Keck | 124/35.2 |
| 3,954,095 | 5/1976 | Lewis | 124/35.2 |
| 4,036,204 | 7/1977 | Scott | 124/35.2 |
| 4,066,060 | 1/1978 | Napier | 124/35.2 |
| 4,105,011 | 8/1978 | Chism | 124/35.2 |
| 4,151,825 | 5/1979 | Cook | 124/35.2 |
| 4,257,386 | 3/1981 | Gazzara | 124/35.2 |
| 4,403,594 | 9/1983 | Todd | 124/35.2 |
| 4,483,798 | 2/1984 | Hamm | 124/35.2 |
| 4,527,536 | 7/1985 | Smith | 124/35.2 |
| 4,620,523 | 11/1986 | Peck | 124/35.2 |
| 4,674,469 | 6/1987 | Peck | 124/35.2 |
| 4,691,683 | 9/1987 | Peck | 124/35.2 |
| 4,854,293 | 8/1989 | Roberts | 124/35.2 |
| 4,881,516 | 11/1989 | Peck | 124/35.2 |
| 4,926,835 | 5/1990 | Peck | 124/35.2 |
| 5,009,214 | 4/1991 | Wilde | 124/35.2 |
| 5,027,786 | 7/1991 | Peck | 124/35.2 |

*Primary Examiner*—Randolph A. Reese
*Assistant Examiner*—Thompson Jeffrey L.
*Attorney, Agent, or Firm*—Andrus, Sceales, Starke & Sawall

[57] ABSTRACT

A bow string release includes a head and body which may be rotated relative to one another, wherein the sear is contained in the head and the trigger is contained in the body. A stiff trigger element is used for translating trigger motion to the sear, the stiff trigger element having a feel similar to that of flexible trigger elements but functional in both the forward and reverse directions as with rigid trigger elements, facilitating reloading of the release.

10 Claims, 1 Drawing Sheet

FIG. 1
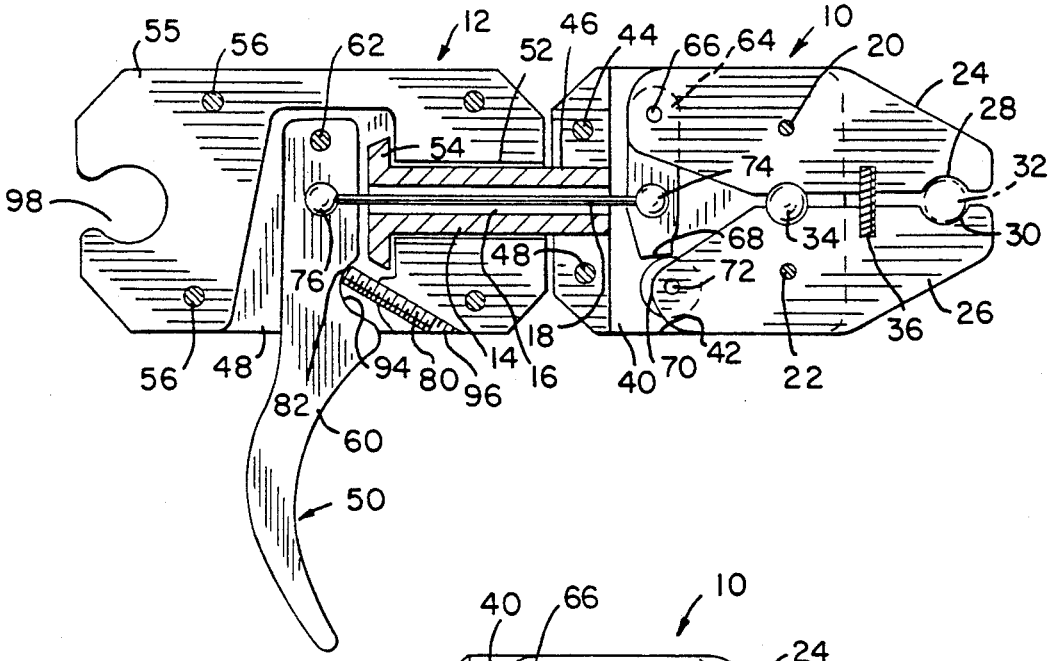
FIG. 3
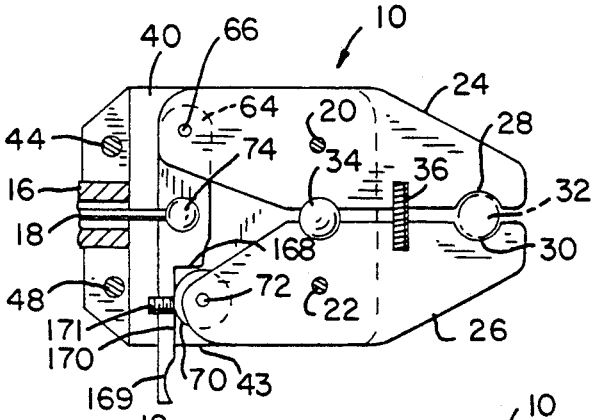
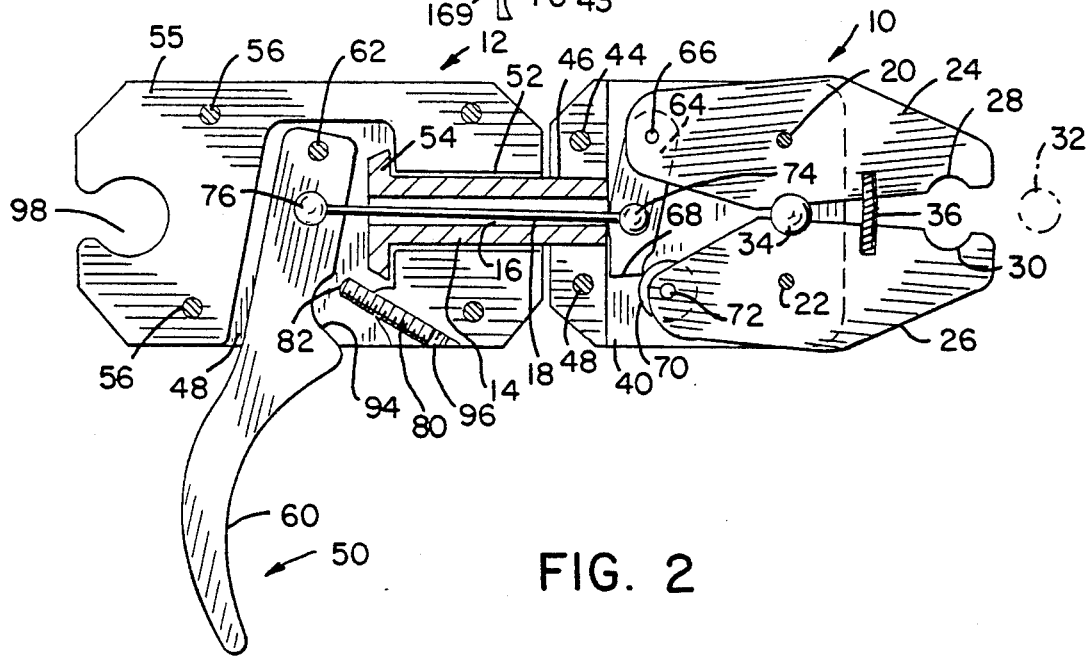
FIG. 2

BOW STRING RELEASE WITH STIFF TRIGGER ELEMENT

BACKGROUND OF THE INVENTION

1. Field of the Invention

The subject invention relates to rotatable bow string releases and is particularly directed to a bow string release having a stiff trigger element.

2. Description of the Prior Art

The subject application is related to my co-pending application Ser. No. 07/535,892 entitled Bow String Release and filed on Jun. 11, 1990 now U.S. Pat. No. 5,078,116.

Many archers involved in both hunting and/or target shooting prefer to use a bow string release in order to more accurately position and hold the string during cocking of the bow and for more precision release of the string. Since archers have various forms of techniques for holding the bow string and bow, it is desirable that the release be rotatable in order to accommodate a large variety of users. A good release provides uniform release of the bow string and increases accuracy. The release is either hand held or strapped to the wrist and has a trigger which permits the archer to release the string.

Typically, such devices employ a pivotal finger that engages the bow string, the finger being pivoted to a release position for releasing the string. Releases of this type are illustrated in U.S. Pat. Nos. 3,898,974, 3,954,095 and 4,066,060. Many of the releases of this type include a head for housing the sear elements and a separate body for the trigger mechanism. A trigger element is disposed between and communicates with both the head and the body for translating the motion of the trigger to the sear. In most devices of the prior art, the trigger is either a fixed rod or pin which is rigid and translates one-to-one motion of the trigger to the sear in both the forward and reverse direction. Other devices utilize a flexible trigger element such as a ball and chain or a cord which is only operable in one direction. A disadvantage to the flexible type of trigger element is that the trigger element is inoperative to re-engage the sear once the trigger has been released, requiring a second mechanism for re-engaging the sear after release. While the rigid trigger elements overcome this problem, they do not have the feel of the flexible trigger element which is desired by many archers.

SUMMARY OF THE INVENTION

The subject invention overcome disadvantages of the prior art by incorporating a trigger element which has both the feel of a flexible ball and chain type element when used to release the string and the desirable reloading capabilities of rigid elements.

In the preferred embodiment of the invention, the trigger element comprises a stiff filament such as nylon or the like which is somewhat flexible, giving the feel of a flexible element when using the trigger. However, the stiff filament retains its shape and has the reloading capabilities of a rigid trigger element.

By utilizing the stiff trigger element of the subject invention, the sear mechanism can be greatly simplified since the trigger element can be used to reload the string release without additional components being required. In this regard, the sear element comprises a pair of pivotal jaws, one of which is controlled directly by the trigger element and the second of which is a follower element which responds to movement of the first jaw and a cam operated action relative to the element.

The bow release of the subject invention is rotatable a full 360°, permitting use of the release and any desired rotational orientation. The trigger action is adjustable to the individual requirements of the user.

It is, therefore, an object and feature of the subject invention to provide a rotatable bow string release having the reload capabilities of a rigid trigger element while operating with a feel similar to that of a flexible trigger.

It is another object and feature of the subject invention to provide for a simple bow string release mechanism wherein the trigger element is used to both release the string and to reload the string.

Other objects and features of the invention will be readily apparent from the accompanying drawing and detailed description of the preferred embodiment.

BRIEF DESCRIPTION OF THE DRAWING

The drawings illustrate the best mode presently contemplated for carrying out the invention, wherein:

FIG. 1 is a top plan view of the bow string release in accordance with the subject invention, with covers removed.

FIG. 2 is a view similar to FIG. 1, illustrating the bow string release in the released position.

FIG. 3 is a fragmentary view similar to FIG. 1, showing an alternative embodiment of the invention.

DETAILED DESCRIPTION OF THE PREFERRED EMBODIMENTS

The bow string release of the subject invention includes a head 10 and body 12 each mounted on a shaft 14. The shaft includes a hollow cylindrical bore 16 for receiving the trigger element 18. The head 10 includes a pair of pivot posts 20 and 22, upon each of which is mounted a sear jaw 24 and 26, respectively. The sear jaws 24 and 26 are pivotable about the pivot posts 20 and 22 between the closed position shown in FIG. 1 and the open position shown in FIG. 2.

In the preferred embodiment of the invention, the sear jaws 24 and 26 have a notch 28 and 30, respectively, for securing the bow string 32, shown in phantom, when the sear jaws are in the loaded, locked position of FIG. 1. In the preferred embodiment, a ball or similar type bearing element 34 is provided and in the closed position of FIG. 1 is in axial alignment with the pivot posts 20 and 22. A compression spring 36 is disposed between the jaws 24 and 26 for normally biasing the jaws into the open position. The ball 34 provides stability to the assembly and rides forward to the position shown in FIG. 2 when the bow string release is released to permit the string 32 to escape.

In the preferred embodiment of the invention, the head comprises a lower half 40, as shown in FIGS. 1 and 2, with a recessed cavity 42 for housing the sear jaws and triggering mechanism. A plurality of mounting posts or other mounts, as shown at 44 and 48, are provided for receiving a complimentary cover (not shown). The cover is designed to encapsulate the sear mechanism within the head and to hold the head on the shaft 14. A central bore 46 is provided in the head and cover for receiving the shaft. In the preferred embodiment, the shaft 14 is rigidly secured to the head, whereby the shaft and head rotate in unison.

The body 12, shown with the cover removed, also includes a cavity 48 for housing the trigger mechanism 50 and a central bore 52 for receiving the shaft 14. An enlarged end 54 on the shaft 14 maintains the head on the shaft, the head being rotatable about the shaft a full 360°. A plurality of posts 56 are provided in the bottom portion 55 of the head and are adapted to receive and secure the cover (not shown) for encapsulating the trigger mechanism and the shaft 14 in the body 12. In the preferred embodiment, the trigger mechanism 50 comprises a base portion 60 which is pivotably mounted on the post 62 provided in the body.

An actuator lever 64 is provided in the head and is pivotably secured to the jaw 24 at pin or post 66. The opposite end of the actuating lever 64 terminates in a cam surface 68, as shown. A cam follower such as the disk or wheel 70 is mounted on the second jaw 26 for rotation about the pin or post 72. The trigger element 18 comprises a stiff nylon filament or the like which extends from the actuating lever 64 to the trigger base 60 and is secured thereto by suitable means such as the ball and socket arrangement shown at 74 and 76.

In operation, the string release is locked in the closed position by engagement of the cam surface 68 with the cam follower 70, providing a rigid lock between the pins 66 and 72, for overcoming the force of the compression spring 36 and holding the sear notches 28 and 30 in the closed position as shown in FIG. 1. When the trigger element 60 is pulled back as shown in FIG. 2, the cam follower 70 rides along the cam surface 68, permitting both jaws 24 and 26 to pivot outwardly, for releasing the bow string 32.

The compression spring 36 normally urges the sear jaws into the open position of FIG. 2. This maintains the jaws in the open position after release, facilitating reentry of the string 32 for reloading. Once the string is placed back into the notches 28 and 30, the trigger is pushed forward to the position shown in FIG. 1, and the filament 18 is stiff enough to push the actuator lever 64 forward, engaging cam follower 70 and pushing both jaws 24 and 26 back to the closed position, where they remain locked until the trigger is again released.

A set screw 80 is provided in the body 12 of the bow release and has an outer end 82 in communication with the notch 84 of the trigger base 60. In the preferred embodiment, the set screw is threaded and is contained in the tapped hole 96. The set screw may be adjusted to control the forward motion of the trigger 50 for calibrating the touch of the release mechanism to the individual desires of the user.

The notch 98 provided in the back end of the body 12 is adapted to receive and secure a standard wrist strap as commonly used with bow string releases, in the manner well known to those skilled in the art.

An alternative embodiment of the head 10 and sear mechanism is shown in FIG. 3. The lower end 168 of the actuator lever 64 includes horizontal surface adapted to engage the roller 70, as in the embodiment of FIGS. 1 and 2. However, a vertical extension 169 is provided on the actuator lever 64 and extends downwardly beyond the lower edge 43 of the head 10 for defining a reset lever. The front surface 170 of the lever 169 acts as a positive stop, limiting the forward motion of the actuator 64 relative to the roller. A set screw 171 may be provided in the lever 169 and may be used to adjust the forward motion of the lever 169 and actuator 64 relative to the roller 70. This permits the archer to adjust the feel of the trigger, in the same manner as the set screw 80 in the embodiment of FIGS. 1 and 2. The reset lever 169 may be used to advance the actuator 64 from the retracted position (see FIG. 2) to the position shown in FIG. 3, whereby the actuator surface 168 engages the roller 70 and moves the sear mechanism from the open position to the closed position for retaining the bow string 32. The actuator lever 169 will also advance the trigger 50 from the retracted position of FIG. 2 to the advanced position of FIG. 1 via the filament 18. It be noted that the configuration of FIG. 3 would permit the configuration shown to be used in combination with a flexible, collapsible actuator such as a chain or the like in addition to the stiff filament 18 shown and described.

While certain features and embodiments of the invention have been described in detail herein, it will be understood that the invention includes all enhancements and modifications within the scope and spirit of the following claims.

I claim:

1. A bow string release of the type having a head containing a pivotable sear mechanism movable between a closed string retaining position and an open string releasing position, a body mounted for rotation relative to the head and having a trigger including means communicating with said sear mechanism and operable to move the sear mechanism between the closed and open positions, the bow string release comprising:

the sear mechanism further including a pair of opposed jaws, each having a complimentary notch for receiving the bow string and each pivotably mounted in said head for pivotable movement of said notches toward each other into the closed position and away from each other into the open position;

an actuator mounted on one of said jaws and secured to said trigger element for moving the sear mechanism in response to the trigger, the actuator comprising an elongate arm having opposite ends with one end pivotably mounted on the one of said jaws and the opposite end of said actuator arm selectively movable between an engaging and non-engaging position with the other of said jaws in response to movement of said trigger; and a flexible, non-stretchable push-pull trigger element having a longitudinal axis and opposite ends secured to the sear mechanism and the trigger, respectively, and movable along its axis in either direction to move the sear mechanism in direct correlation to movement of the trigger wherein said jaws may be moved to the closed position by applying a pushing force to said trigger element.

2. The bow string release of claim 1, further including biasing means associated with said jaws for normally urging the jaws into the open position.

3. The bow string release of claim 2, wherein said biasing means comprises a compression spring disposed between the pivot point of said jaws and said complementary notches.

4. The bow string release of claim 2, further including a floating bearing element disposed between said jaws in axial alignment with the respective pivot points of the jaws when the sear mechanism is in the closed position.

5. The bow string release of claim 1, wherein the actuator arm includes an outer end having a cam surface and wherein the other of said jaws further includes a cam follower mounted adjacent its said other end, whereby said cam surface engages and disengages said cam follower in response to movement of said trigger.

6. The bow string release of claim 5, including means for adjusting the maximum travel of said trigger.

7. The bow string release of claim 1, further including a cylindrical shaft having opposite ends and a central hollow bore therethrough, and wherein said trigger element is disposed in said bore, the head of said bow string release mounted on the outer peripheral surface of said shaft and said body mounted for rotation on the opposite end of said shaft, whereby the body may be rotated relative to the head.

8. The bow string release of claim 7, wherein said trigger element comprises an elongate filament having enlarged outer ends, and wherein said sear mechanism and said trigger each include a complementary receptacle for receiving one of said enlarged outer ends.

9. The bow string release of claim 1, the elongate actuator arm further including means for providing a positive stop for limiting the movement of the actuator relative to the other of said jaws.

10. The bow string release of claim 9, wherein said elongate actuator arm includes a reset lever extending beyond the head of said bow string release for manually moving the actuator lever between the engaging and non-engaging positions.

* * * * *